United States Patent [19]

Fang et al.

[11] 4,196,234

[45] Apr. 1, 1980

[54] METHOD OF MANUFACTURING SULFUR-COATED BAMBOO REINFORCEMENT MEMBER FOR CONCRETE ARTICLES

[76] Inventors: Hsai-Yang Fang, 1847 Markham Dr., Bethlehem, Pa. 18017; Harshavardhan C. Mehta, 37-A Southern Ave., Calcutta, 700029, India

[21] Appl. No.: 966,742

[22] Filed: Dec. 5, 1978

Related U.S. Application Data

[62] Division of Ser. No. 784,686, Apr. 5, 1977, Pat. No. 4,137,685.

[51] Int. Cl.[2] ..... B05D 7/06

[52] U.S. Cl. ..... 427/291; 427/317; 427/440

[58] Field of Search ..... 52/722, 727, 733, 737; 427/291, 440, 4, 325, 317; 428/17

[56] References Cited

U.S. PATENT DOCUMENTS

| | | | |
|---|---|---|---|
| 825,870 | 7/1906 | Schirra | 427/204 X |
| 1,006,173 | 10/1911 | Aine | 242/7.22 |
| 1,018,624 | 2/1912 | Kolossvary et al. | 427/291 |
| 1,617,447 | 2/1927 | Johnston | 52/722 |

OTHER PUBLICATIONS

Perry, John H. (ed.), *Chemical Engineers' Handbook,* 3rd ed., 1949, McGraw-Hill Book Co., New York City, pp. 1241-1242.

*Primary Examiner*—Evan K. Lawrence

[57] ABSTRACT

A method of manufacturing a bamboo rod reinforcement member for concrete comprises roughening a surface of the rod to expose the cortex, dipping the rod in a bath of molten sulfur, and drying the hot-dipped rod to form a substantially continuous coating of crystallized sulfur to prevent moisture absorption and swelling of the rod.

1 Claim, No Drawings

METHOD OF MANUFACTURING SULFUR-COATED BAMBOO REINFORCEMENT MEMBER FOR CONCRETE ARTICLES

This is a division, of application Ser. No. 784,686, filed Apr. 15, 1977, U.S. Pat. No. 4,137,685.

BACKGROUND OF THE INVENTION

Bamboo is one of the fast growing perennial grasses. Individual rods of bamboo, referred to as culm, are divided into sections by joints or knobs referred to as nodes. In many parts of the world, bamboo is utilized as a low-cost construction material. When individual rods are utilized as a reinforcement member for concrete or cementitious bodies, the bamboo absorbs moisture from the fresh concrete. As bamboo absorbs the water, swelling occurs, and the volume of the bamboo increases. If the swelling pressure is large enough, the bamboo pushes the wet concrete aside. At the end of the curing period, (approximately 21 days), the concrete becomes hard, the bamboo has lost its water and shrinks, leaving voids between the bamboo rod surface and the concrete.

Such voids can trap air, moisture, and other foreign materials which will accelerate decay of the bamboo rod, causing cracks in the structure. Also, voids lead to a loss of bond, or adherence, between the bamboo and surrounding concrete.

It is well known to coat the bamboo rods with various materials, such as paint, tar, cement, and asphalt emulsion, in order to reduce the water absorption potential of bamboo. Unfortunately such techniques are either too expensive or ineffective due to difficulty of application.

Therefore, there is a need for a treated bamboo which can resist swelling due to absorption of moisture, and thereby prevent loss of bond with surrounding concrete in a reinforced concrete body.

SUMMARY OF THE INVENTION

The present invention is a process for producing a moisture resistant, non-swelling bamboo suitable for concrete reinforcement by applying to a roughened bamboo rod surface, the bamboo cortex, a substantially continuous coating of crystallized sulfur derived from dipping the bamboo rod in a bath of molten sulfur. Prior to hot dipping, the bamboo rod may be wrapped with fine wire to further prevent swelling. An alternate embodiment includes embedding particles of sand in the sulfur coating to further improve bond stress of the rod after it is embedded in a concrete matrix.

DESCRIPTION OF PREFERRED EMBODIMENTS

In the preferred embodiment, the swelling resistant sulfur-coated bamboo is produced according to the following procedure:

Bamboo rods are first dried to remove moisture. Drying can be in a conventional drying oven or by air drying. For air drying, a period of up to two months is recommended.

The smooth outer skin of the bamboo is roughened. By roughened, we mean that the waxy cuticle of the bamboo epidermis is removed, to cause proper adherence of sulfur and bamboo. We have discovered that crystallized sulfur will not adhere to the bamboo properly after hot-dipping unless the smooth outer bamboo skin is removed.

We believe that proper adherence of sulfur is a result of the molten sulfur contacting the cortex below the epidermis and penetrating and adhering to the fibers known as sclerenchyma fibers, which fibers, as is well known surround the irregularly spaced vascular bundles of the bamboo culm.

We prefer to roughen the surface, or remove the bamboo cuticle, by conventional sand blasting, although other mechanical means, such as stripping with cutters or grinders can be used, as well as chemical means such as acid stripping.

Wire is wrapped in a helical fashion around the rod to prevent swelling. However other materials, such a rope, will work.

The bamboo rod is soaked, or hot dipped, in molten sulfur for about one hour. The time is not critical. The sulfur temperature should be maintained between 238° F. and 300° F., a temperature at which molten sulfur has low viscosity, enhancing sulfur penetration into the bamboo fibers. If the temperature is too high, the bamboo may burn, and if the temperature is too low, the sulfur is too viscous. After the hot dipping period, the bamboo is air dried to form a substantially continuous, impervious coating of crystallized sulfur on the bamboo.

It is important that the sulfur coating be continuous, that is, have no gaps, leaving bare spots of exposed bamboo. In other words the sulfur coating must not have any pinhole openings, which pinholes could permit moisture penetration.

Multiple coatings can be used, but the bond between bamboo and surrounding concrete is not significantly improved, although more sulfur improved the bending stress of the bamboo.

We prefer to apply sulfur in an amount between 5% and 15% by weight of the starting bamboo rod, or equivalently, a thickness of coating between 1 to 6 mm.

We prefer to use commercial grade flour sulfur, 99.9% purity, having, as a solid, a specific gravity of 2.08. Such sulfur, as is well known, has mainly two allotropes, the alpha (rhombic) and beta (monoclinic) phases. The rhombic phase is the stable form at temperatures up to 203.9° F., and therefore, the crystallized, continuous, elemental sulfur coating on the bamboo rods is in the rhombic phase.

We believe that common impurities in the sulfur can be present without deleterious effects. Such impurities can include acid, ash, and other carbonacious compounds in the range commonly found in sulfur.

As an alternate embodiment, sand can be applied to the sulfur before the sulfur has completely crystallized, or dried. Sand increases the bond between bamboo and concrete.

To illustrate the effectiveness of a crystallized-sulfur-coated bamboo rod in concrete, the following example is described.

EXAMPLE I

Bamboo specimens were air dried for two months. The smooth bamboo skin was removed by sand blasting, and 28 gage wire helically wrapped around some of the rods. Specimens were soaked for about one hour in molten sulfur at a temperature around 280° F. to 300° F. Sand was applied to the sulfur coating before it completely dried.

Each bamboo rod was inserted into a cylindrical form containing concrete of the following analysis by volume: one part cement, ASTM standard type A, four parts aggregate, two parts sand, and a water to cement ratio of 0.4 to 0.55.

After a curing period of 21 days, the bond stress was measured by determining the force required to pull the bamboo out of the concrete, or to break the rod if it did not come out.

Table I shows the results for a bamboo rod having no modes immersed in the concrete.

Table I

| Type Sample | Pull Force - lbs. |
|---|---|
| Untreated Bamboo | Pulled out |
| Sulfur-Coated Bamboo | 2315 |
| Sulfur-Coated Bamboo Wrapped with Wire | 2380 |

Table i illustrates a significant increase in bond stress resulting from the treated bamboo of this invention.

Of course, for specimens having nodes within the concrete, the pull force may vary due to the added resistance to slipping presented by the nodes alone.

Examination of similarly treated specimens was done by sectioning the concrete parallel to the length of bamboo to determine whether or not voids developed between the bamboo surface and surrounding concrete. In all cases, untreated bamboo exhibited voids and decreased adherence of concrete due to the swelling and subsequent shrinkage of bamboo, as hereinbefore described.

All bamboo treated according to the invention had substantially no void formation between the bamboo surface and surrounding concrete. The concrete substantially completely contacted and adhered to the sulfur-coated surface of the bamboo.

We believe it would be equivalent to split individual bamboo rods lengthwise and utilize them as reinforcement members for concrete bodies pursuant to the teaching of the invention disclosed herein.

We also believe it within the scope of this invention to sulfur coat the internal surface of the bamboo culm, in accordance with the teachings herein, to produce a hollow conduit suitable for conducting water without swelling.

We claim:

1. A method for producing a moisture resistant non-swelling bamboo rod reinforcement member for concrete bodies comprising:

(a) drying said bamboo rod;

(b) roughening a surface of said bamboo rod by removing the waxy cuticle of epidermis to expose the cortex;

(c) hot dipping said bamboo rod in a bath of molten sulfur at a temperature between 238° F. and 300° F., and (d) drying said hot-dipped bamboo rod to form a substantially continuous coating of crystallized sulfur contacting and adhering to said cortex of said bamboo rod to prevent moisture absorption and swelling.

* * * * *